US009147305B2

(12) United States Patent
Shelton et al.

(10) Patent No.: US 9,147,305 B2
(45) Date of Patent: Sep. 29, 2015

(54) SYSTEM AND METHOD FOR DISSEMINATING DIGITAL IMAGES

(75) Inventors: Gerold K. Shelton, Meridian, ID (US); Curtis Gold, Meridian, ID (US); Cameron Hutchings, Meridian, ID (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 1953 days.

(21) Appl. No.: 12/253,134

(22) Filed: Oct. 16, 2008

(65) Prior Publication Data

US 2009/0257091 A1 Oct. 15, 2009

Related U.S. Application Data

(60) Provisional application No. 61/043,942, filed on Apr. 10, 2008.

(51) Int. Cl.
*G07F 17/26* (2006.01)

(52) U.S. Cl.
CPC ..... *G07F 17/26* (2013.01)

(58) Field of Classification Search
USPC ..... 358/1.11, 1.18, 403
See application file for complete search history.

(56) References Cited

U.S. PATENT DOCUMENTS 6,367,991 B1 * 4/2002 Garfinkle et al. ..... 396/639
6,383,080 B1 * 5/2002 Link et al. ..... 463/47
6,701,302 B1 * 3/2004 Schaeffer et al. ..... 705/26.8
6,757,684 B2 * 6/2004 Svendsen et al. ..... 1/1
6,791,723 B1 * 9/2004 Vallmajo et al. ..... 358/488
6,915,273 B1 * 7/2005 Parulski ..... 705/26.5
6,958,821 B1 * 10/2005 McIntyre ..... 358/1.12
7,013,288 B1 * 3/2006 Reifel et al. ..... 705/14.1
7,154,534 B2 * 12/2006 Seki et al. ..... 348/207.1
7,275,044 B2 * 9/2007 Chauvin et al. ..... 705/26.8
7,343,319 B1 * 3/2008 Walker et al. ..... 705/21
7,355,746 B2 * 4/2008 Murray et al. ..... 358/1.9
7,660,007 B2 * 2/2010 Uchida ..... 358/1.15
2002/0029339 A1 * 3/2002 Rowe ..... 713/182
2002/0057452 A1 * 5/2002 Yoshino ..... 358/1.15
2002/0112005 A1 * 8/2002 Namias ..... 709/206
2003/0038835 A1 2/2003 DeFelice
2003/0187673 A1 * 10/2003 Needham et al. ..... 705/1
2004/0012811 A1 * 1/2004 Nakayama ..... 358/1.15
2004/0186792 A1 9/2004 Sales et al.
2005/0091119 A1 * 4/2005 Tuijn et al. ..... 705/26
2006/0088284 A1 4/2006 Shen et al.
2006/0092266 A1 * 5/2006 Morgan ..... 348/14.01
2006/0264209 A1 * 11/2006 Atkinson et al. ..... 455/422.1

* cited by examiner

*Primary Examiner* — Paul F Payer
(74) *Attorney, Agent, or Firm* — Van Cott, Bagley, Cornwall & McCarthy

(57) ABSTRACT

A method of distributing digital images includes uploading one or more digital image files corresponding to one or more digital images to an interactive kiosk; receiving user input of contact information for one or more third party recipients; and sending notice to the one or more third party recipients that the one or more digital images are available. A photo printing and networking system includes a kiosk for uploading one or more digital image files corresponding to one or more digital images; a kiosk network in electronic communication with the kiosk; and data transfer means for transferring the one or more digital image files from the kiosk to a third party recipient via the kiosk network.

13 Claims, 5 Drawing Sheets

SYSTEM AND METHOD FOR DISSEMINATING DIGITAL IMAGES

CROSS REFERENCE TO RELATED APPLICATIONS

This Application claims the benefit of provisional patent application Ser. No. 61/043,942, filed Apr. 10, 2008 titled "System And Method For Disseminating Digital Images" which application is incorporated by reference herein as if reproduced in full below.

BACKGROUND

Many retail stores and other public locations have installed interactive kiosks that allow patrons easier access to quality photograph printing. A user may operate a digital camera to take digital photographs that are then stored electronically as digital image files on the camera or some other data storage device. The user may then transfer the digital image files to the interactive kiosk. Once the data is transferred to the kiosk, the user may edit and print the photographic images. Typically, such kiosks print pictures on photographic print media with a high image quality.

The entire process starting with the uploading of the digital images and ending with the printed photographs may take only minutes to complete. Therefore, one advantage to using an interactive photo kiosk is that the user can acquire digital photograph prints almost instantaneously and in a retail location that the user would tend to frequent.

Online photo printing is another method by which a user may obtain prints of digital images. The user may upload digital images to a website, optionally edit the digital images, and have the online photo printing service print and deliver the images to the user.

Such online services are convenient for a user because the user does not have to go to another location to print photos, but may, instead, do so from home by simply uploading the digital images to the online service. The online service then prints the digital images and sends or delivers the photographs to the user. Another advantage to online photo printing is that the cost for each individual print is typically less than other conventional photo printing options.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
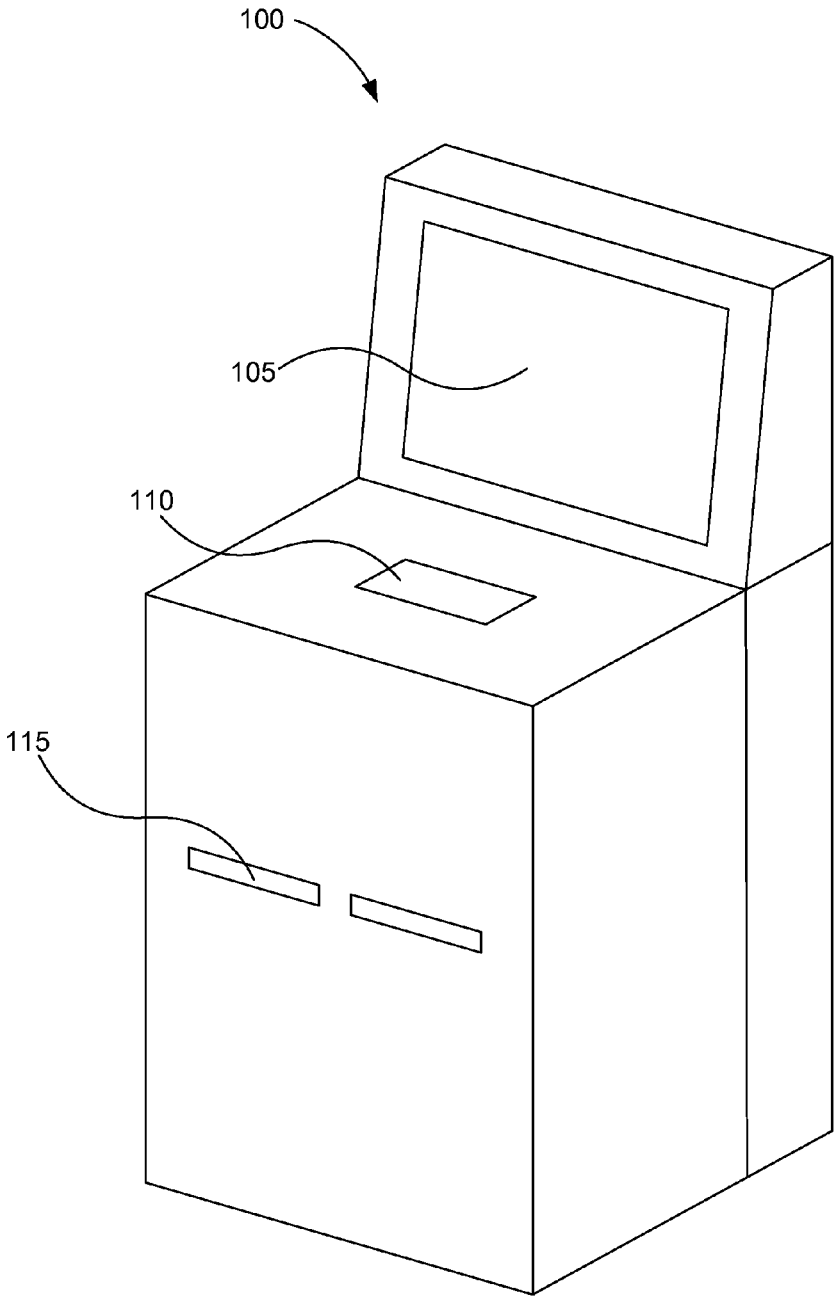
FIG. 1 is a prospective view of a kiosk according to one illustrative embodiment of the principles disclosed herein.

The present specification describes, among other things, a system and method of disseminating digital images via an interactive kiosk. The user of an interactive kiosk may upload digital image files to the kiosk, edit, and print the images. During the session, the user may decide or be prompted to disseminate the digital images to one or more third party recipients. If the user desires to do so, the user is then prompted to provide contact information, such as an email address or mobile phone number, for each third party recipient, and may designate which digital images to send to each third party recipient.

Upon receipt, the third party recipient may access the images the original user has uploaded and may also order hardcopy prints of some or all of the images. Consequently, uploaded images not only produce initial sales of digital photo prints to the user of the interactive kiosk, but also secondary sales of the same prints to those third party recipients who are able to view and order prints of the original user's digital photographs.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

As used herein and in the appended claims, the term "kiosk" will be used broadly to refer to an electronic system with a user interface that is located, for example, in a public or retail location. The kiosk includes the capability to receive electronic image files and produce hardcopy prints of the images from those files. As described herein, such a kiosk may be in communication with one or more data networks including, for example, the Internet.

As used herein and in the appended claims, the term "digital image" will be used broadly to refer to any image that is stored using digital data. Consequently, the term "digital image file" will be used broadly to refer to any data organized as an electronic file that corresponds to one or more images. The image represented by a digital image file may be a photograph or any other visual image. Additionally, a digital image file may comprise the data for motion picture video including a series of image frames.

As noted above, both photo kiosks and online services are presently used to obtain hardcopy prints from digital photographs or other digital image files. Examples of each are described below.

Examples of photo kiosks include self-contained units typically installed in retail stores and other public locations. These kiosks typically have a display device, graphical user interface, data ports for receiving digital image files and digital image processing features. Such kiosks are typically interactive self-serve units that allow patrons to upload digital image files. Once the data is transferred to the kiosk, the user may edit and print the photographic images. The kiosk may also be configured to accept electronic payment, such as with a credit card, for the prints produced.

Turning to online photo printing services, one example of such a service is Snapfish®. Snapfish® is a web-based photo sharing and print service currently owned and operated by Hewlett-Packard Co. It has more than 40 million members and one billion unique photos stored online. Members are able to share, print and store digital images. Snapfish® provides its members with professionally-developed digital image prints for less cost than other conventional means, free online photo sharing, unlimited online photo storage, free editing tools and software, wireless imaging services, and personalized photo products, including calendars, mugs, mouse pads, etc.

While both interactive kiosks and online photo printing services have their individual advantages, either method may be more advantageous in certain situations. For example, several issues exist for those users who choose interactive kiosks to upload and print digital images. One such issue arises when the user desires to supply digital images or digital photographs to a third party recipient such as a friend or family member. While at the kiosk, the user may print additional copies of the digital images and give those physical copies to the desired recipient. However, this requires the user to spend additional money on printing, and it may be difficult to deliver the photographs to the third party recipient due to the time required, mailing costs, etc.

Another issue may arise when the user of the interactive kiosk finishes printing his or her photographs at the retail location and later finds that he or she failed to print all the photographs or copies desired. In order to print additional digital images, the user must then return to the retail location and upload the digital images again for additional printing.

On the other hand, online photo printing services allow a user to disseminate or share with third party recipients photographs that he or she has uploaded to the Internet. Third part recipients may then browse the user's digital images and order any number of prints from among those digital images. Further, the original user may place any number of orders for additional prints of digital images at any time without having to return to a kiosk. Additionally, online photo printing does not produce digital photo prints almost instantaneously, as does the interactive kiosk. Rather, the user may have to wait some period of time for the ordered prints to be delivered.

Consequently, the present specification describes, among other things, a system and method of disseminating digital images via an interactive kiosk. The user of an interactive kiosk may upload digital image files to the kiosk, edit, and print the images. During the session, the user may decide or be prompted to disseminate the digital images to one or more third party recipients. If the user desires to do so, the user is then prompted to provide contact information, such as an email address or mobile phone number, for each third party recipient, and may designate which digital images to send to the third party recipient(s).

The kiosk is then able to notify the designated third party recipient(s) that the original user's images are available. The kiosk can then distribute the digital images to third party recipients, according to any of several techniques described herein, via a network connection provided with the kiosk. In some embodiments, the kiosk may be networked with an online photo service such as that described above. With such a kiosk, as noted above, uploaded images not only produce initial sales of digital photo prints to the user of the interactive kiosk, but also secondary sales of the same prints to those third party recipients who are able to view and order prints of the user's digital photographs.

A textual notice, website address or some version of the digital images acquired by the interactive kiosk may be sent to the third party recipient(s). Where the images themselves are sent, they may be sent either as individual images or an album of digital images. The images sent to the third party recipient (s) may be sent as thumbnails of the digital images to allow the third party recipients to view the images, but also allowing the online photo print service the opportunity to make more sales of digital photo prints to the third party recipients.

The third party recipients may then order as many prints of the digital images as they wish. This purchase may be made via the communication channel that was used initially to send notice of the images to the third party recipient or the third party recipient may be directed to a website to view, select and pay for the digital images to be printed. The online print service then prints the digital images chosen by the third party recipient and sends or delivers the prints. Thus a secondary market is created by employing the ability to share photos with third party recipients via the interactive kiosks.

Further, the initial user of the interactive kiosk may also order more prints of his or her digital images after the initial session at the interactive kiosk. The user may either return to the kiosk to order more prints or do so via a website or other electronic link as explained herein in connection with the third party recipients. This is possible because the digital images may be stored in the memory of the interactive kiosk or on a server connected to a kiosk network.

The digital image files may be stored on the kiosk or the server for a specified amount of time. This time period may be long enough for subsequent orders of prints to be performed, but short enough to allow for the memory to be freed up for uploading other consumer's digital images. In some embodiments, the storage period for the image files is reset and restarted any time someone purchases a print from an image file indicating that interest in that image file continues. In some embodiments, the user may be allowed to specify a time period for retention of the digital image files on the memory of the kiosk or the server.

FIG. 1 is a prospective view of a kiosk (100) according to one illustrative embodiment. The kiosk (100) may be positioned in a retail store where patrons of the store may easily gain access to the kiosk. Such kiosks typically include a user interface (105). The user interface (105) may include, but is not limited to, a display device including a touch sensitive screen, keyboard, mouse, or any other peripheral device that allows a user to interact with the kiosk (100).

The kiosk may also include one or more data ports (110) for transferring data from the user's data storage device to the kiosk (100). The data ports (110) may be engineered to interface with several types of data storage devices such as, but not limited to, magnetic, optical and solid-state storage devices. Specifically, these devices may include flash memory devices, digital cameras, cell phones, personal digital assistants (PDA's), MP3 players and other devices that are capable of taking or storing digital images.

Finally, the housing of the kiosk (100) may provide for and include a photograph tray (115). The photograph tray (115) holds dispensed photographs the user has requested the kiosk (100) to print. Not shown in FIG. 1 and internal to the kiosk (100) is a complete print engine with a supply of photographic paper for printing high quality photographs as desired by a user and delivering those photographs to the tray (115). More details regarding the process by which the kiosk (100) prints photographs will follow below.

Figure 2:
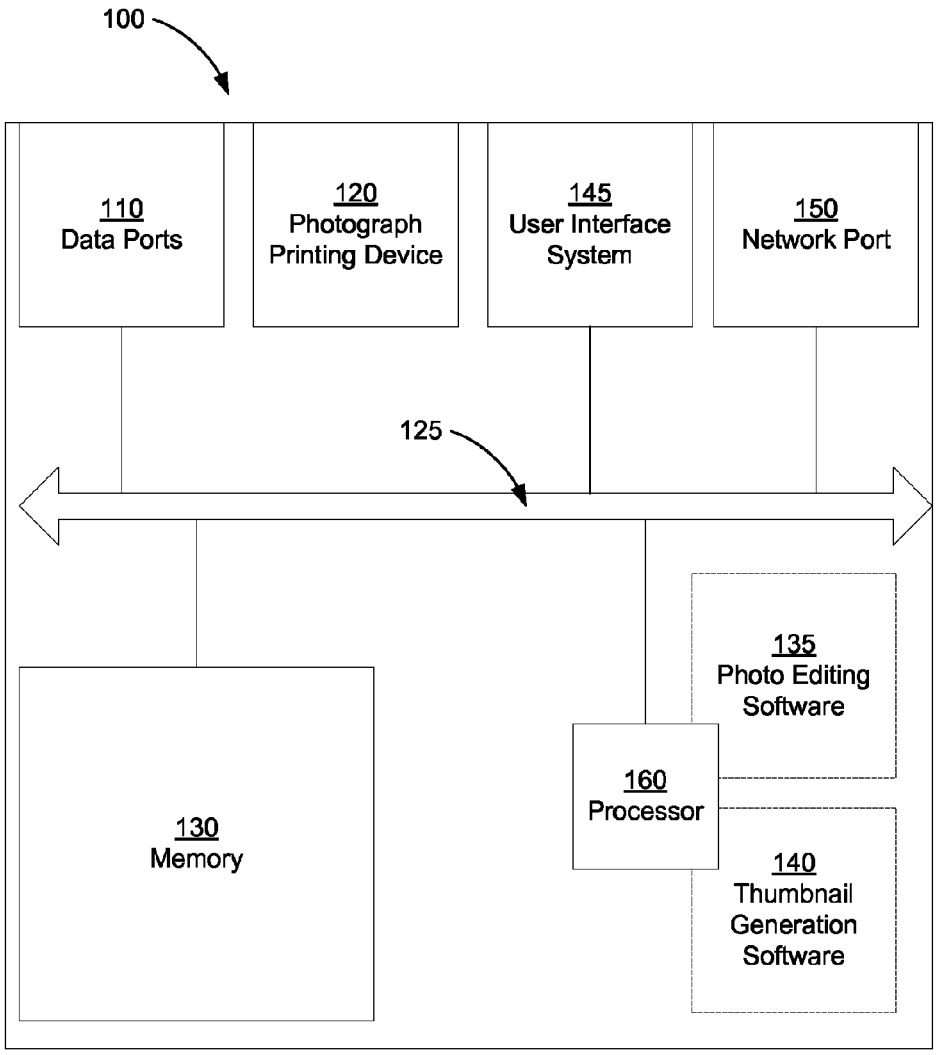
FIG. 2 is a block diagram of a kiosk according to one illustrative embodiment of the principles disclosed herein.

FIG. 2 is a block diagram of the kiosk (100) according to one illustrative embodiment. As shown in FIG. 2, the kiosk (100) includes a central processing unit (160) and memory (130), which will include both static and random access memory. A data bus (125) connects and provides communication between the internal elements of the kiosk (100).

The kiosk (100) may also include software (135) for editing parameters of the digital image. This software (135) may include functions such as a red-eye reduction function, a cropping function, a color alteration function, and other functions as are useful for a user to edit a digital image.

Additionally, as stated above, the kiosk (100) includes one or more data ports (110). The set of data ports (110) may include, for example, a universal serial bus (USB) port, connectors for various data ports found on a variety of digital cameras and devices that incorporate a digital camera and any other port a user may find useful in uploading digital image files to the kiosk (100). Any number of data ports (110) may be included in the kiosk (100).

As noted above, the kiosk (100) includes a photograph printing device or print engine (120). The printing device (120) is controlled by the processor (160) through a connection to the data bus (125).

Once the user has uploaded the digital image files to the kiosk (100), those image files are stored in the memory (130). The corresponding images may then be displayed in the user interface system (145), including a display device, as described above. Using the user interface system (145), the user may then select which images he or she would like to print. Optionally, the user may edit the image in order to change certain parameters of the digital images.

The user then requests the kiosk (100) to print the selected digital images. The processor (160) then sends the digital image data of the selected/edited digital images to the photograph printing device (120). The photograph printing device (120) then prints the digital images as high quality photographs on an appropriate print medium. After the digital images have been printed, the photographs are dispensed by the printing device (120) to the photograph tray (115, FIG. 1) where the user may retrieve them.

As noted above, the kiosk includes memory (130) that may be used for storing the digital image data that the user uploads to the kiosk. The memory (130) may be any device for storing data such as, but not limited to, magnetic, optical and solid-state storage devices. In one embodiment, the memory (130) may include a hard drive. In another embodiment, the memory (130) may include flash memory.

The memory (130) may also include non-volatile or read-only memory that contains the software or firmware executed by the processor (160). The memory (130) may also include random access memory into which such software is loaded for execution by the processor (160).

For example, the kiosk processor (160) may execute thumbnail generation software (140) for generating thumbnails of the digital images stored in the memory (130) or other memory accessible to the processor (160). As will be discussed in more detail below, the thumbnail images allow a third party recipient to view the image thumbnails while still providing for increased sales of photographic prints.

Finally, the kiosk (100) includes a network port (150) for transferring the digital images or digital image files from the kiosk to a kiosk network, as will be discussed in more detail below. This network port (150) may connect the kiosk (100) to, for example, the Internet or a local network with Internet access.

Figure 3:
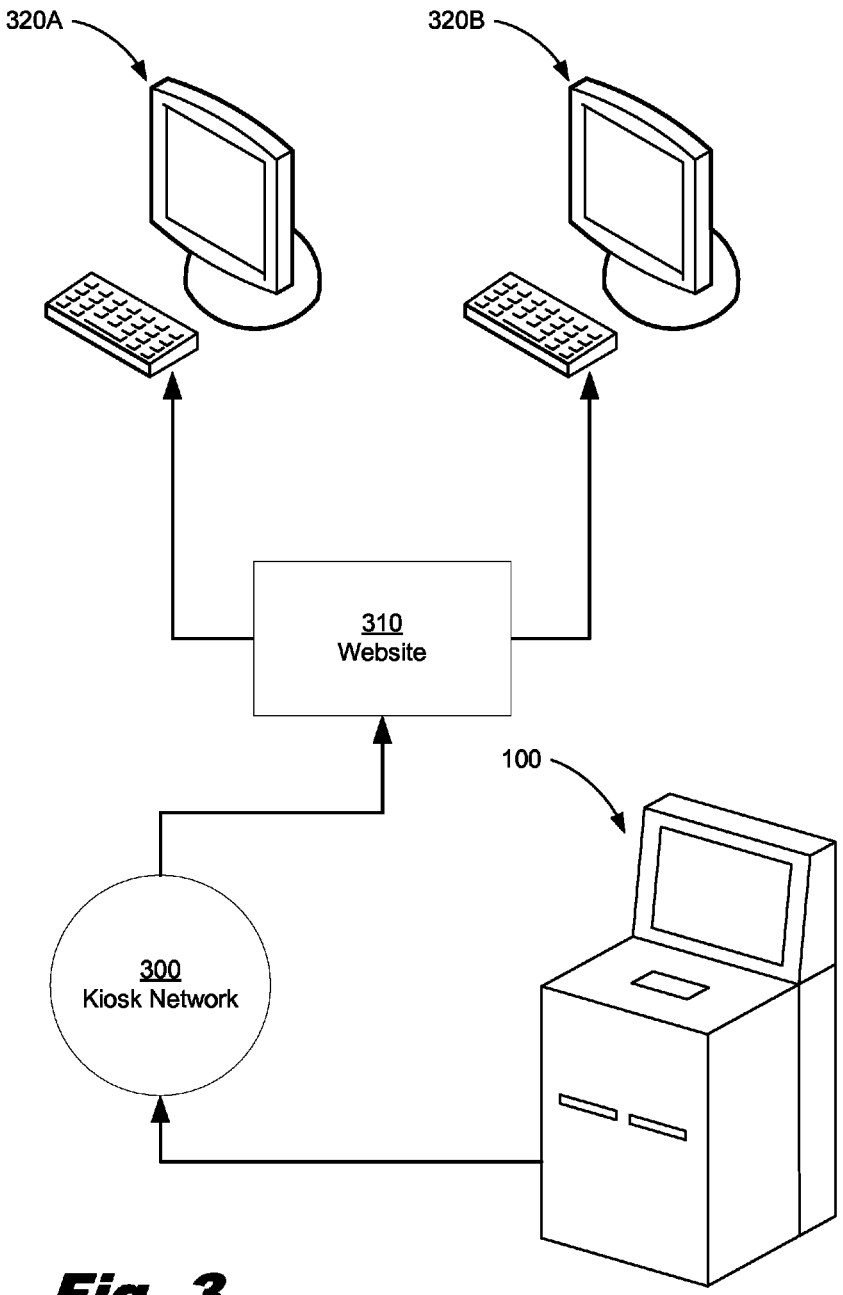
FIG. 3 is a schematic diagram of a kiosk network system according to one illustrative embodiment of the principles disclosed herein.

FIG. 3 is a schematic diagram of a kiosk network system according to one illustrative embodiment. The interactive kiosk (100) is connected to a kiosk network (300). In some embodiments, the digital image files may be uploaded to a website (310) via the kiosk network (300). As indicated above, the kiosk network (300) may be connected to the Internet or may be the Internet.

Where the kiosk (100) is connected to the Internet, the user and/or a third party recipient may then view the digital images at a website (310) via a personal computer (320A, 320B). In some embodiments, the website (310) may be a site served up by an embedded web server in the kiosk (100). In other embodiments, the digital image files may be transferred from the kiosk (100) to a separate web server or online service that supports the website (310) at which the images can be viewed.

Additionally, with email addresses or mobile phone numbers provided by the user through the user interface of the kiosk (100), the kiosk may send email or text messages to the designated email addresses to notify intended recipients of the existence of the uploaded digital images. Such a notification message may include thumbnails of the images uploaded or may simply include a link to the website (310) where the images can be accessed and viewed.

In any of these embodiments, both the user and a third party recipient may access the digital images and request that selected images be printed in hardcopy form and delivered. In another embodiment, the user or the third party recipient may go to an interactive kiosk (100) and access and print the digital images via the interactive kiosk (100). The kiosk (100) used to access and print the digital images need not be the same one where the original user uploaded digital image files, but may be any kiosk in a network of related kiosks that can transfer digital image files via the kiosk network (300).

Figure 4:
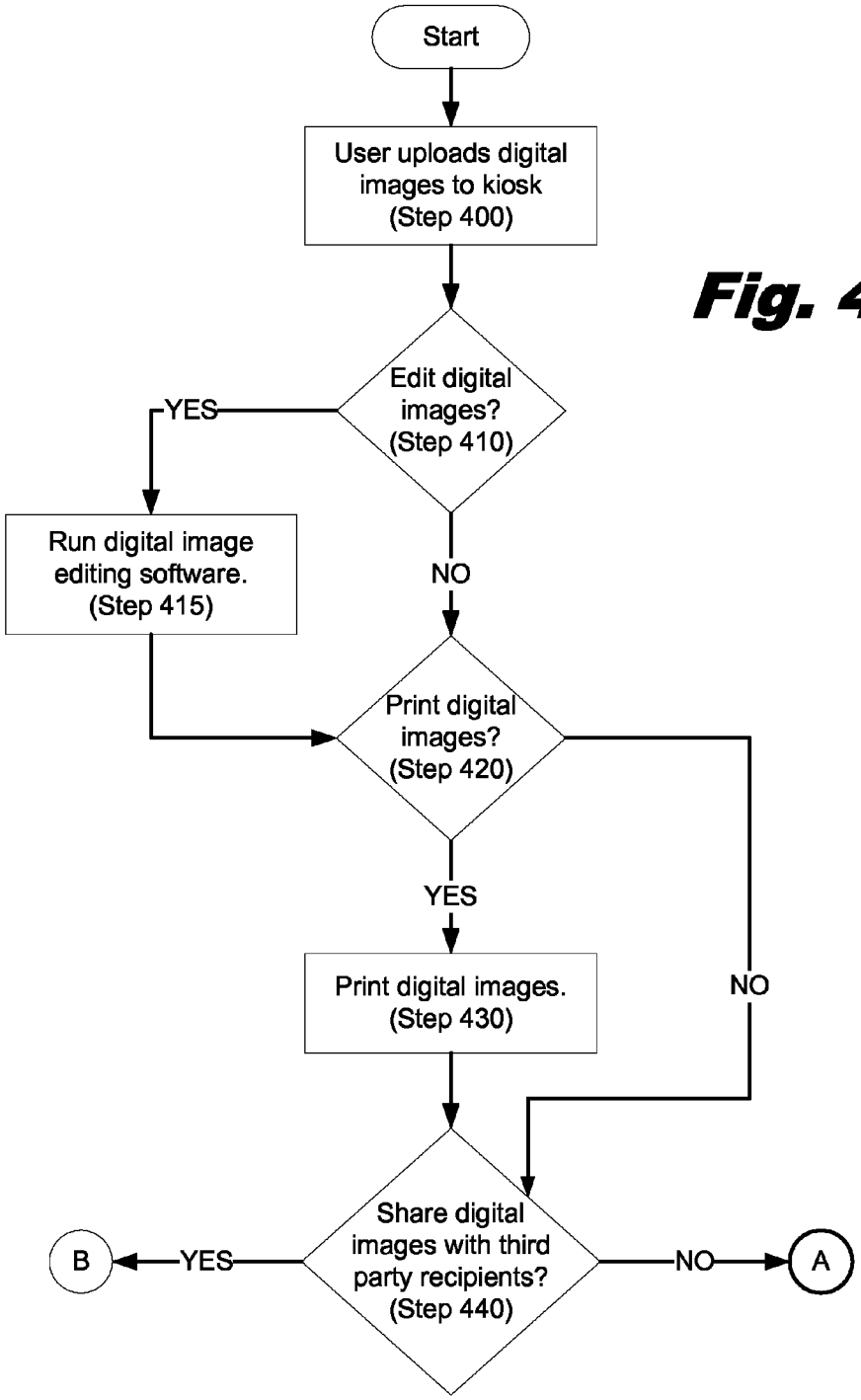
FIGS. 4 and 5 present a flow chart of a method of disseminating digital images via a kiosk network system according to one illustrative embodiment of the principles disclosed herein.
Figure 5:
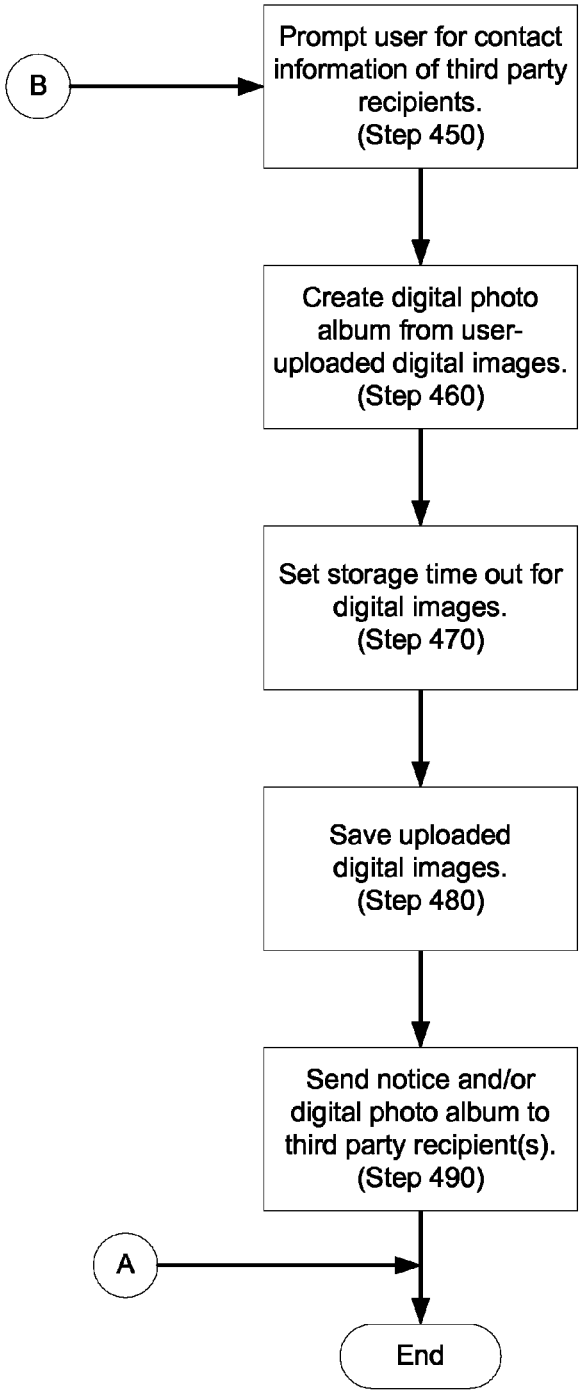

FIGS. 4 and 5 present a flow chart of a method of disseminating digital images via a kiosk network system according to one illustrative embodiment. The method by which a user is to disseminate the digital images to third party recipients will now be discussed. First, the user uploads the digital images to the interactive kiosk (Step 400). For example, the user connects his or her data storage device to a data port of the kiosk and transfers the digital image files to the kiosk. In other embodiments, the user may transfer the image files to the kiosk wirelessly, for example, using Bluetooth™ or other wireless protocols.

In one embodiment, the interactive kiosk may automatically upload the data representing the digital images as soon as a connection is made between the kiosk and the user's camera or data storage device. In another embodiment, the kiosk may upload the data representing the digital images only after the user directs the interactive kiosk to do so. In yet another embodiment, the interactive kiosk may upload specific data representing specific digital images after a user chooses that data and directs the interactive kiosk (100) to upload those specific digital image files.

Next, the interactive kiosk may then inquire as to whether the user would like to edit the digital images (Step 410). If the user does not wish to edit the images, the user may bypass the step of editing the uploaded digital images (Step 410, determination NO). If the user does, however, wish to edit the digital images uploaded to the interactive kiosk, then the user may proceed to do so (Step 410, determination YES). As discussed above, the interactive kiosk may then run digital image editing software (Step 415) for editing parameters of the digital images.

Once the user is finished editing the digital images, the interactive kiosk may inquire as to whether the user would like to print the digital images (Step 420). At this point, if the user does not wish to print the digital images, the interactive kiosk may proceed to the option of sharing the digital images with third party recipients (step 420, determination NO, to step 440). However, if the user does wish to print the digital images, the photograph printing device of the kiosk then prints the digital images (step 430) and dispenses the prints to the photograph tray where the user may retrieve them.

Next, the user may select or the interactive kiosk may prompt the user to decide whether the user would like to share the digital images with third party recipients (Step 440). If the user does not wish to disseminate the digital images to any third party recipients, then the interactive kiosk session is terminated (step 440, determination NO). However, if the user does wish to allow the digital images to be disseminated to one or more third party recipients (step 440, determination YES), then the user is prompted to provide contact information for the third party recipients (step 450 via B at FIG. 5). This contact information may include, among other types of information, email addresses or mobile phone numbers of those people to whom the user wishes to disseminate the digital images. The user then inputs the contact information.

After the contact information is inputted to the interactive kiosk, the interactive kiosk may create a digital photo album of the images uploaded to the interactive kiosk (step 460). In one embodiment, all the images uploaded to the interactive kiosk (100) during the session are included in the digital photo album. In another embodiment, only those images indicated by the user are included in the digital photo album. The digital images may also be converted into thumbnails via the thumbnail generation software of the kiosk, as discussed above.

The interactive kiosk also sets the storage time out for the digital images (Step 470). In one embodiment, the storage time out may be a set time period. For example, the storage time out period may be thirty days from the time the image files were uploaded to the interactive kiosk. In another embodiment, the storage time out period may be a set time period running from the most recent order of prints of the digital images. For example, the storage time out period may be thirty days from the time of upload to the interactive kiosk or thirty days from the most recent order of prints of the digital images from the user or third party recipient. In yet another embodiment, the user may determine the storage time out period.

In any such case, the digital images are also stored (step 480) for a period of time. In one embodiment, the digital images are stored in the memory of the interactive kiosk. In another embodiment, the digital images are stored on a separate network server.

Finally, the interactive kiosk (100) notifies the third-party recipients of the availability of the digital images (Step 490). In some embodiments, the kiosk may send an email or a Short Message Service (SMS) message or text notifying the third-party recipients where to access the digital images. This message may also include the identity of the user who originally uploaded the images to the kiosk along with, in some cases, a personalized message introducing the images to the third party recipient that was entered into the kiosk by the original user.

In other embodiments, the kiosk sends the digital photo album described above to the selected third part recipients (step 490). The digital photo album may be sent, as discussed above, via email or SMS message. In one embodiment, the images are sent to the third party recipients via transmission control protocol internet protocol (TCP/IP) or other protocol.

Once the digital photo album has been sent to one or more third party recipients, any of the third party recipients may access the thumbnails of the digital images and place orders for prints of the digital images. The user may include him or herself in the list of third party recipients by listing his or her emails address or other contact information as one of the third party recipients. Orders may be placed at a kiosk or at a user's or third party recipient's personal computer connected to the internet. In either situation, the prints of the digital images may be delivered to the purchaser's specified address via postal service, courier or other means, or to the retail location of the kiosk where the original purchase occurred.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method of distributing digital images, comprising:

uploading a number of digital image files corresponding to a number of digital images to an interactive kiosk;

prompting a user to input contact information for a number of third party recipients;

sending notice to the third party recipients that the digital images are available; and processing a number of requests from the third party recipients to print the digital images.

2. The method of claim 1, wherein the contact information comprises an email address.

3. The method of claim 1, wherein the contact information comprises a mobile phone number.

4. The method of claim 1, further comprising storing the digital image files in a data storage device accessible to the kiosk.

5. The method of claim 4, wherein the one or more digital image files are retained in a server.

6. The method of claim 4, wherein the one or more digital image files are retained for a specified amount of time.

7. The method of claim 6, in which the specified amount of time is user definable.

8. The method of claim 1, further comprising generating thumbnails of the digital images; wherein the notice comprises the thumbnails.

9. The method of claim 1, wherein the notice comprises a link to a website where the digital images can be viewed.

10. The method of claim 1, further comprising receiving an order from a number of the third party recipients for a hardcopy print of one or more of the digital images.

11. The method of claim 10, further comprising delivering the hardcopy print to the third party recipient who ordered the print.

12. A method of increasing sales of digital image prints, comprising:

with a digital photo kiosk, prompting a user to provide contact information for a number of third party recipients;

sending a number of digital image files to the third party recipients; and processing a number of requests to print the digital image files from the third party recipients.

13. The method of claim 12, in which the digital image files is video data comprising a series of image frames.

* * * * *